US006460502B2

(12) United States Patent
Gracyalny

(10) Patent No.: US 6,460,502 B2
(45) Date of Patent: Oct. 8, 2002

(54) ENGINE CYLINDER HEAD ASSEMBLY

(75) Inventor: Gary J. Gracyalny, Milwaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 09/792,256

(22) Filed: Feb. 24, 2001

(65) Prior Publication Data

US 2002/0117143 A1 Aug. 29, 2002

(51) Int. Cl.[7] ..... F02F 1/00
(52) U.S. Cl. ..... 123/193.5
(58) Field of Search ..... 123/193.5, 184.21, 123/184.23

(56) References Cited

U.S. PATENT DOCUMENTS 4,300,494 A * 11/1981 Graiff et al. ..... 123/193.5
4,676,064 A * 6/1987 Narita et al. ..... 123/193.5
6,026,774 A * 2/2000 Kajihara et al. ..... 123/184.21

* cited by examiner

*Primary Examiner*—Marquerite McMahon
(74) *Attorney, Agent, or Firm*—Michael Best & Friedrich LLP

(57) ABSTRACT

A cylinder head assembly having a cylinder head and an adapter. The intake cavity of the cylinder head is relatively large, and the adapter fills a portion of the space in the cavity. The cylinder head has an intake runner that decreases in cross-sectional area as it progresses inward from the entrance to the intake port. The adapter has a runner filler that decreases in cross-sectional area as it extends away from a spacer, and is inserted into the intake runner. The volume of the runner filler is smaller than the volume of the intake runner, so a cavity is left within the intake runner. This cavity forms a portion of the intake passageway that leads from the carburetor to the cylinder. The position of the intake position may be altered to accommodate clearance problems with devices in which an engine is incorporated.

31 Claims, 10 Drawing Sheets

ENGINE CYLINDER HEAD ASSEMBLY

FIELD OF THE INVENTION

The present invention relates, generally, to internal combustion engines, and more particularly, to internal combustion engines used in snow blowers, generators, vegetation cutting devices such as lawn mowers, or other outdoor power equipment.

BACKGROUND OF THE INVENTION

Internal combustion engines are a common power source for various types of outdoor power equipment, such as lawn mowers or lawn tractors. In the engine industry, the engine manufacturer is usually different than the original equipment manufacturer ("OEM"). The engine manufacturer typically supplies engines to several different OEMs, all of which have different requirements for the location and placement of the engine. Redesigning engines to fit into confined spaces of existing OEM devices, such as lawn mowers or lawn tractors, significantly increases costs for the engine manufacturer. Thus, it is desirable for an engine manufacturer to have a flexible engine design and manufacturing method which can be easily modified to make engines that accommodate a variety of existing devices.

Cylinder heads for engines are commonly made using a die casting method. When die casting, it is cost effective to maximize the number of parts fabricated with each die tool, and to use simple, compact die tools. Therefore, the layout of the die tool is an important factor in designing a part. Die casting prior art cylinder heads often requires an intake runner core or insert that must be inserted diagonally ("diagonal slide") relative to the die opening direction. A diagonal slide can create a variety of parts, but it makes the tooling more complex and requires extra space and limits the number of parts each tool can make at the same time. Using straight slides, which move transverse to the die opening direction, restricts some prior art design options, but maximizes the efficiency of each die tool.

SUMMARY OF THE INVENTION

The present invention solves some of the problems of redesigning engines to fit existing OEM devices by forming an intake runner cavity that is relatively large, and then filling at least some of the cavity space with a runner filler to form and position the intake passageway as desired. The present invention allows the same die tool to make cylinder heads with different intake positions. The cylinder heads are also die cast using straight slides to maximize the number of parts made with each simple, compact die tool.

An important factor when an OEM selects an engine to use on a specific device is the location of certain engine parts, such as the intake position, mounting brackets, and drive shaft. An engine may not be compatible with an OEM device (e.g. a lawnmower deck) because existing features of the device interfere with parts of the engine. For example, there may not be enough room near the engine's intake position for a carburetor and fuel tank. This invention provides the flexibility to alter the intake position of an engine without redesigning the engine. This invention also enables a cylinder head incorporating the invention to be readily connected to a carburetor which would otherwise be at a different elevation than the intake passageway. Therefore, the engine can be used on a wider range of OEM devices.

The cylinder head assembly of the present invention includes a cylinder head and an adapter. The cylinder head has an entrance, an intake runner, and an intake port. The entrance is an opening on a side of the cylinder head. The intake runner, which connects the entrance to the intake port, decreases in cross-sectional area from the entrance to the intake port. The intake port is disposed between the intake runner and the combustion chamber.

The adapter is interconnected with the cylinder head and includes an inlet, a spacer, and a runner filler which is disposed within the intake runner. The inlet receives the air/fuel mixture from the carburetor. The spacer lies against the face of the cylinder head and acts as a thermal insulator for the carburetor. The runner filler is disposed within the cylinder head and at least partially forms the intake passageway that leads from the inlet to the intake port, and has a substantially uniform cross-sectional area.

In a preferred embodiment, the entrance is elliptical in cross-sectional shape. The intake runner cross-sectional area decreases between the elliptical entrance and the circular intake port. The adapter inlet is preferably a cylindrical opening that opens into the intake passageway. The runner filler is disposed within the intake runner, and at least part of the intake passageway surface is defined by the intake runner and runner filler. The crosssectional area of the intake passageway is substantially circular and substantially uniform.

In another embodiment, the entrance and intake runner can be of any shape. At the pentrance, the height dimension is larger than the width dimension. As the intake runner progresses from the entrance towards the intake port, the height dimension decreases until it is substantially the same as the width dimension.

In another embodiment, the entrance could be circular in cross-section, and the intake runner could be circular in cross-section at least near the entrance. The entrance could possibly be any shape, although an important factor is how the shape of the intake passageway affects the flow of the air/fuel mixture. The intake runner cross-sectional area could decrease in any manner, but again, an important factor is how the shape affects the air/fuel flow in the intake passageway.

In another embodiment of the present invention, at least a portion of the intake passageway is entirely enclosed within the runner filler. The runner filler completely defines at least a segment of the intake passageway between the inlet and the intake port. The intake runner may be any shape as long as the intake passageway maintains a substantially uniform cross-sectional area in the runner filler, and leading from the inlet to the intake port.

Another alternate embodiment of the present invention changes the orientation of the intake runner and adapter. In a preferred embodiment discussed above, a line containing the height dimension of the entrance is substantially transverse to a longitudinal axis of a piston cylinder. In this alternate embodiment, a line containing the height dimension of the entrance is substantially parallel to a longitudinal axis of a piston cylinder. The intake runner and adapter may also be oriented at any angle between those two locations.

In a carburetor engine, the air/fuel mixture is regulated by the carburetor, and anything that disrupts the air/fuel flow in the intake passageway of a carburetor engine may reduce engine efficiency by creating flow losses or by altering the air/fuel mixture.

The present invention provides a substantially straight and uniform passageway from the carburetor to the cylinder. This objective is achieved by altering the intake position while maintaining a relatively short and straight intake passageway.

The ability to alter the cylinder head's intake position allows the engine manufacturer to use existing engine designs for different OEM devices. This feature of the invention reduces costs for the engine manufacturer and OEMs and increases flexibility to adapt an engine to an OEM device.

Other features and advantages of the invention will become apparent to those skilled in the art upon review of the following detailed description, claims and drawings.

BRIEF DESCRIPTION OF THE DRAWINGS

In the drawings, wherein like reference numerals indicate like parts.

Figure 1:
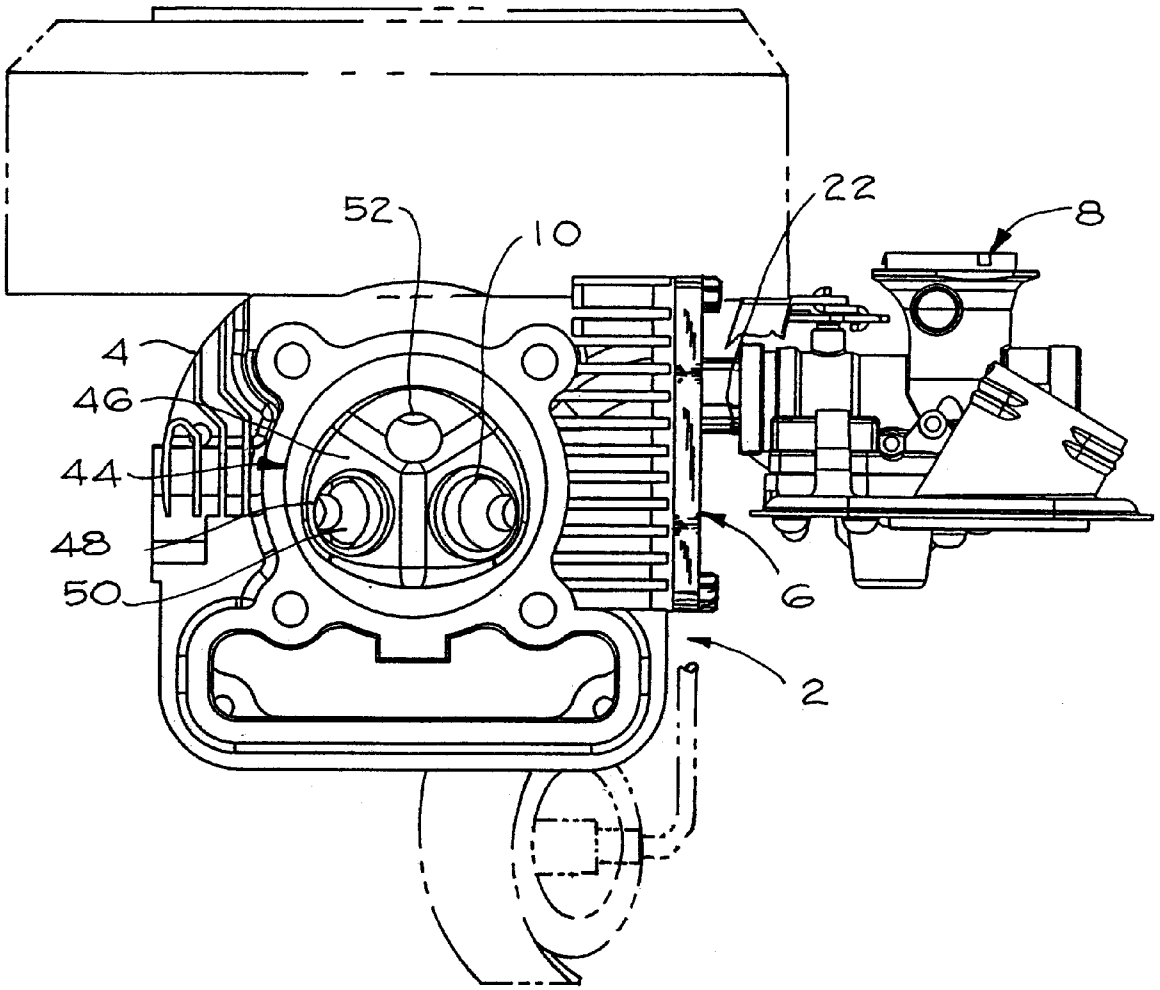
FIG. 1 is an end view of the cylinder head assembly and carburetor according to a preferred embodiment of the present invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 4:
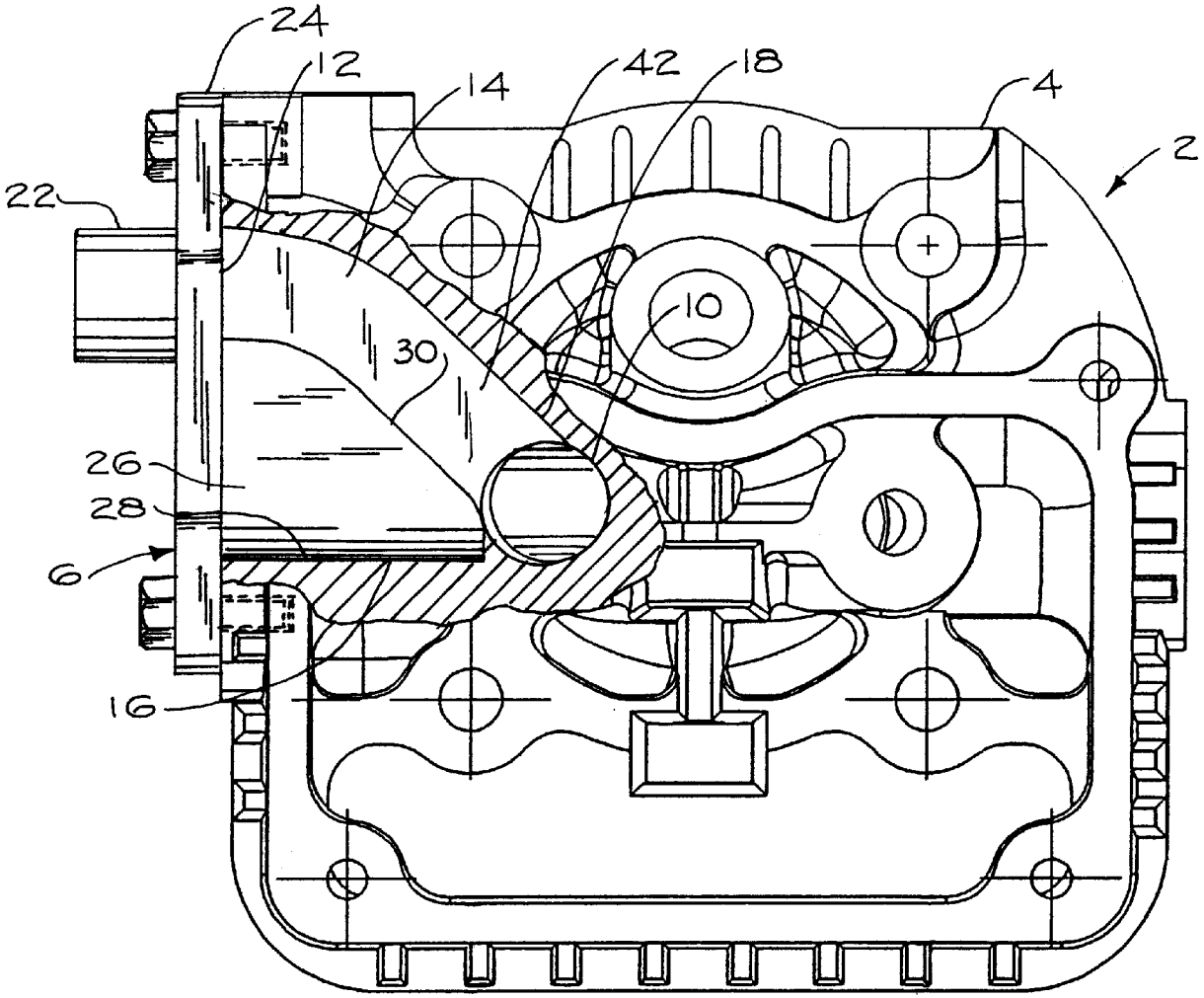
FIG. 4 is a cross-sectional view of the cylinder head assembly shown in FIG. 2, illustrating the runner filler within the intake runner.

A preferred embodiment of the cylinder head assembly 2 of the present invention is illustrated in FIG. 1 as it would appear in an engine. The present invention may be used with any conventional engine and cylinder head. One such cylinder head 4 is shown by way of example only in the figures. The cylinder head assembly 2 is typically connected to a conventional carburetor 8 and a cylinder 44, and forms an end of a combustion chamber 46. The carburetor 8 creates the proper air/fuel mixture and is connected to the adapter 6 at the inlet 22. As shown in FIG. 4, the air/fuel mixture proceeds into the inlet 22 and through the intake passageway 42. In FIG. 1, the air/fuel mixture then passes through the intake port 10 and into the combustion chamber 46 of the cylinder 44. The cylinder head 4 also includes an exhaust port 48, an exhaust passageway 50 and a spark plug hole 52.

Figure 2:
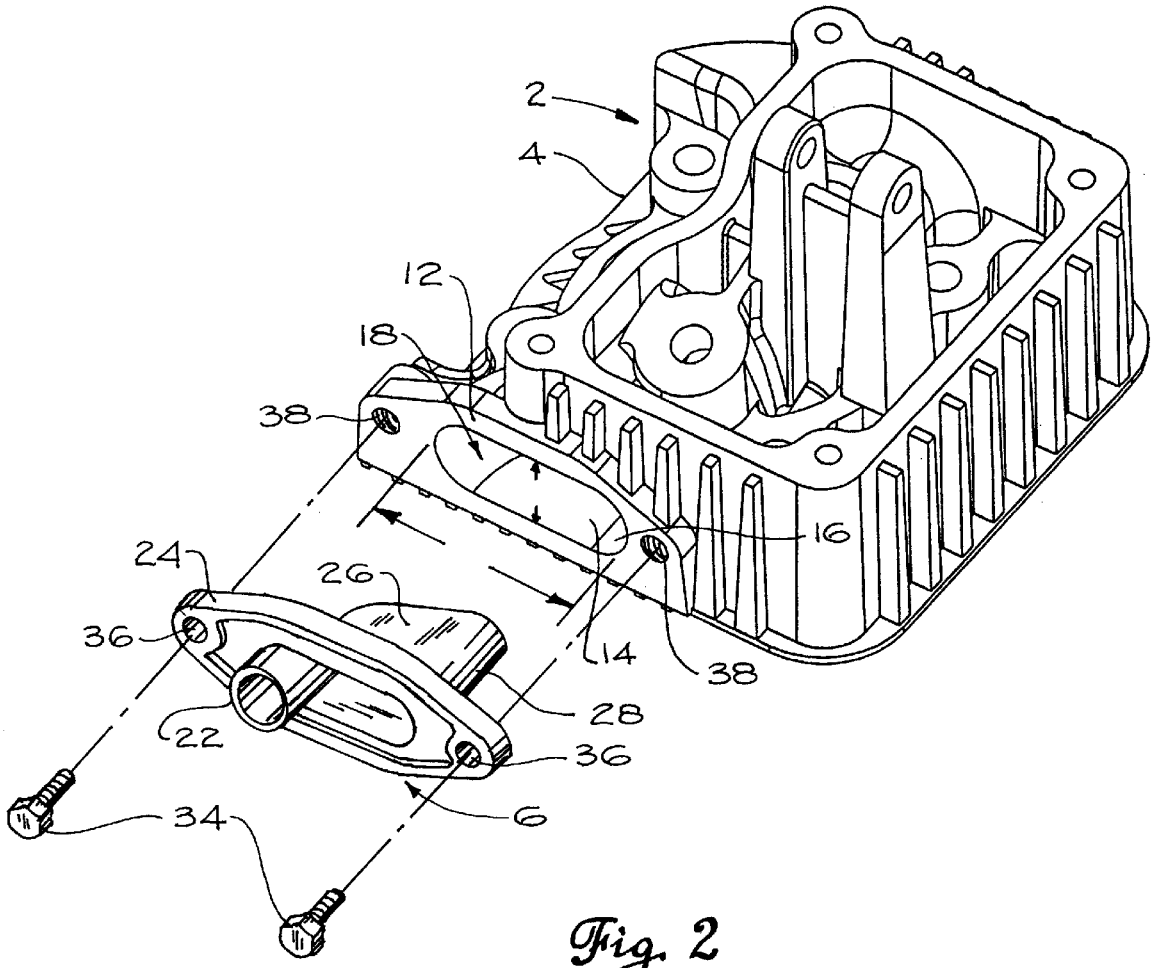
FIG. 2 is an exploded view of the cylinder head assembly shown in FIG. 1, illustrating the adapter and the cylinder head.
Figure 3:
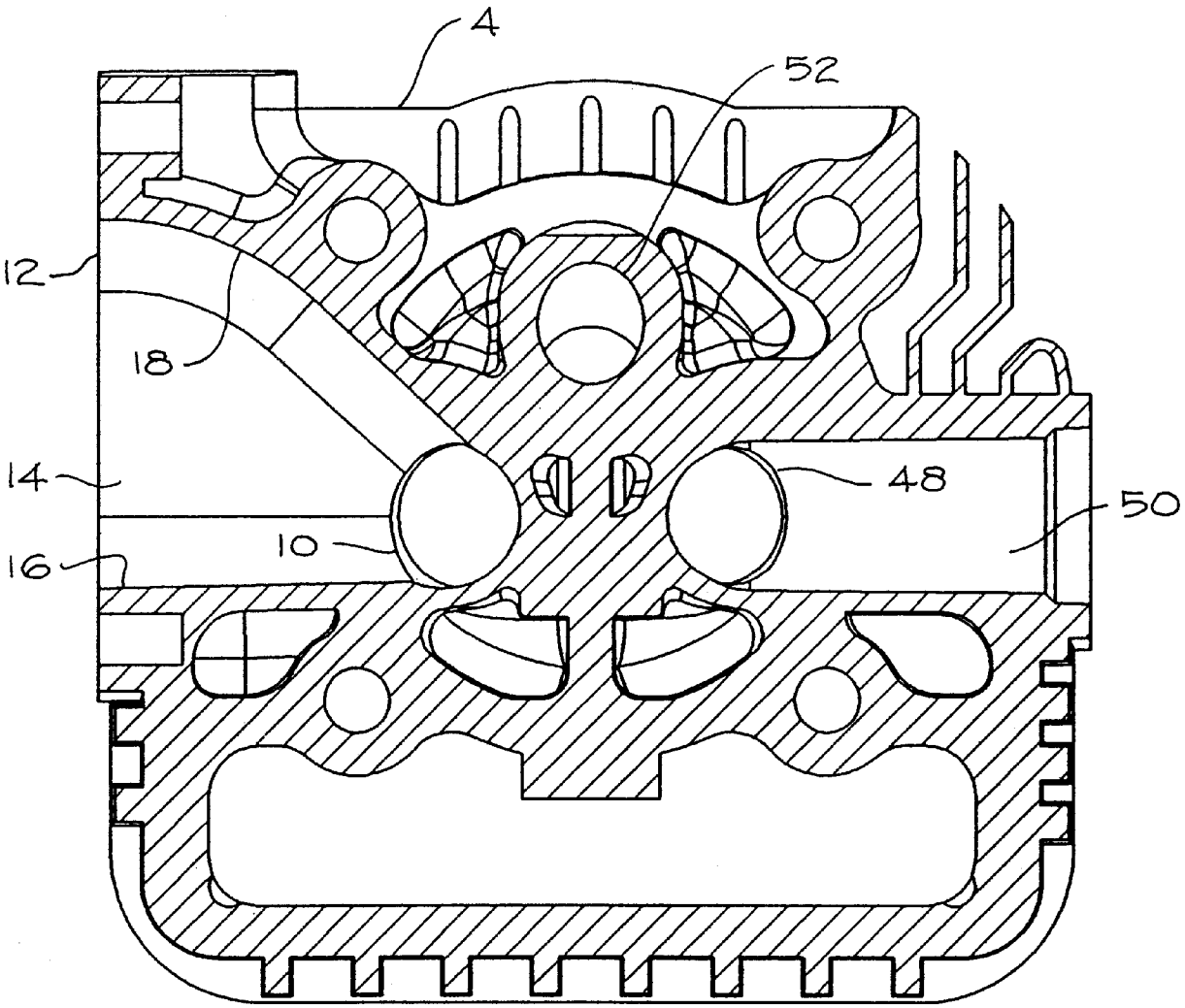
FIG. 3 is a cross-sectional view of the cylinder head shown in FIG. 2, illustrating the intake runner.

As illustrated in FIGS. 2 and 4, the cylinder head assembly 2 includes a cylinder head 4 and an adapter 6. The cylinder head 4, as can best be seen in FIGS. 2 and 3, includes an entrance 12, an intake runner 14, and an intake port 10. Preferably, the entrance 12 has an elliptical shape and is on a side face of the cylinder head 4 (FIG. 2). The entrance 12 has a height dimension (h) and a width dimension (w). In this preferred embodiment, a line containing the height dimension (h) is substantially transverse to a longitudinal axis of a piston cylinder. The intake runner 14 starts at the entrance 12, and the cross-sectional area of the intake runner 14 preferably decreases as the intake runner 14 approaches the intake port 10. As the intake runner 14 progresses from the entrance 12 to the intake port 10, the height dimension (h) preferably decreases until it is approximately equal to the width dimension (w).

The intake runner 14 preferably has a straight side 16 and an inclined side 18. The straight side 16 preferably has a surface of a segmented cylinder. The inclined side 18 preferably has a semi-circular cross section and begins at the end of the entrance opposite the straight side 16. The distance between the inclined side 18 and the straight side 16 preferably decreases as they approach the intake port 10. The intake port 10 is disposed between intake runner 14 and the cylinder 44 (FIG. 1), and permits the intake runner 14 to be in fluid flow communication with the cylinder 44 (FIG. 1).

Figure 7:
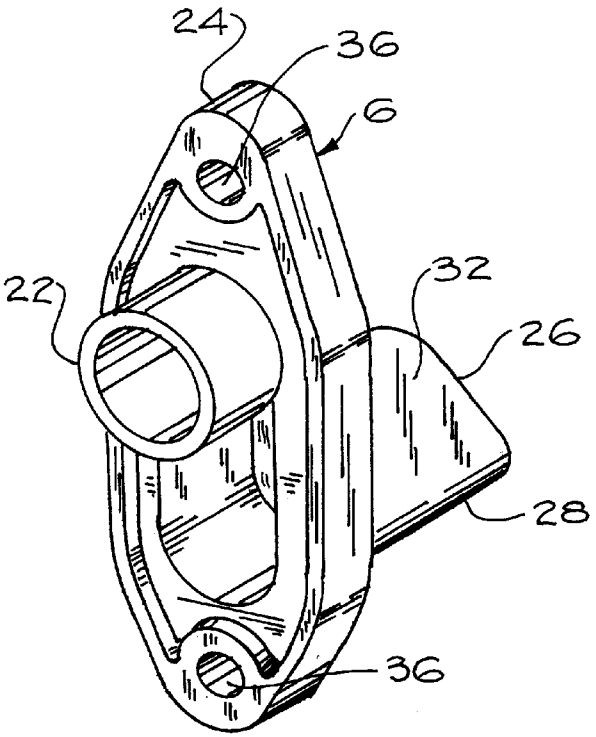
FIG. 7 is a perspective view of the adapter shown in FIG. 2, illustrating the spacer and inlet.
Figure 6:
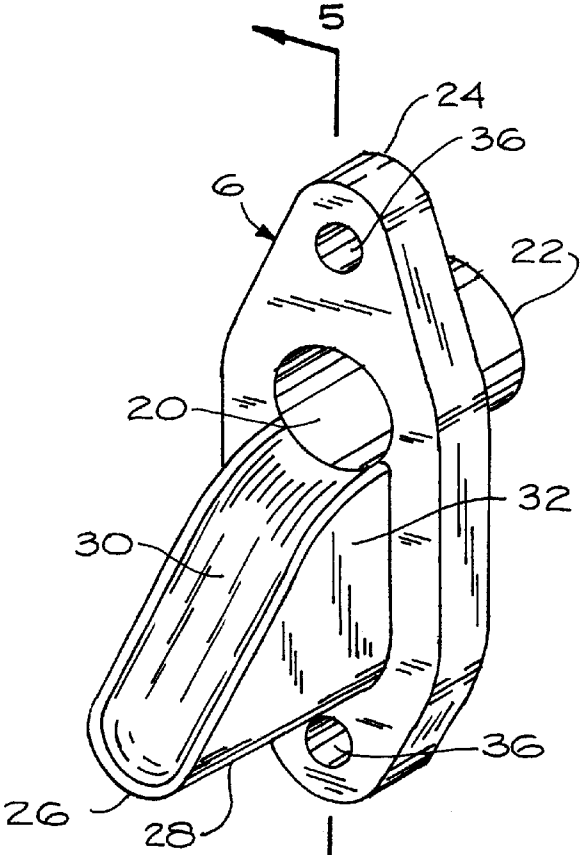
FIG. 6 is a perspective view of the adapter shown in FIG. 2, illustrating the spacer and runner filler.
Figure 5:
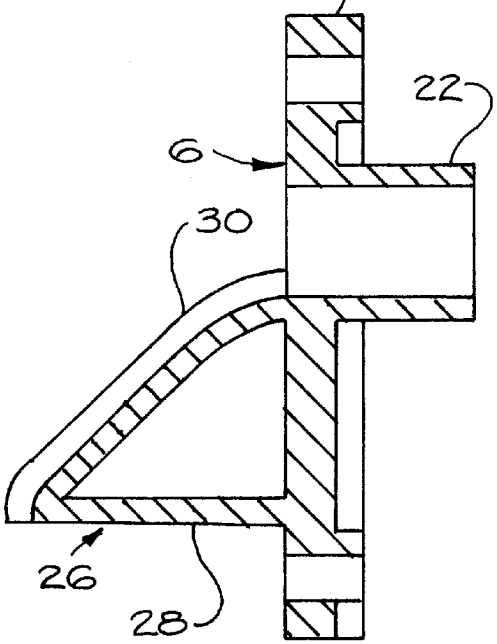
FIG. 5 is a cross-sectional view of the adapter.

As shown in detail in FIGS. 5, 6 and 7, the adapter 6 includes an inlet 22, spacer 24, and runner filler 26. One with ordinary skill in the art will recognize that the adapter 6 can be made out of several materials using various methods of manufacture. In the preferred embodiment, the adapter 6 is made of plastic using injection molding.

As illustrated in FIG. 7, the inlet 22 is preferably an open cylindrical extension with a substantially circular cross-sectional area. The inlet 22 is preferably long enough to interconnect to the carburetor 8.

In FIG. 6, the cylindrical opening of the inlet 22 continues through the spacer 24 to from the spacer opening 20. The surface of the spacer 24 with the runner filler 26 preferably lies against a face of the cylinder head 4. The spacer 24 may be solid or hollow and the thickness may vary, as long as the spacer provides adequate thermal insulation for the carburetor 8. The thickness of the spacer 24 in the preferred embodiment is approximately 0.35 inches.

The runner filler 26 preferably has two side surfaces 32, a contact surface 28, and a passage surface 30. Preferably, the contact surface 28 has the shape of a segmented cylinder and extends substantially normal from the spacer 24. The passage surface 30 preferably has a semi-circular cross-section and intersects the contact surface 28 at the end of the runner filler 26. When viewed from the side, as in FIG. 5, the runner filler 26 in the preferred embodiment has a substantially triangular profile. Preferably, the edges of the passage surface 30 have a slight radius near the spacer 24 and near the end of the runner filler 26. These slight curves smooth the change in direction of the intake passageway 42 (FIG. 4).

In an alternate embodiment, the side profile of the runner filler 26, as viewed similar to FIG. 5, could be a quarter circle shape, or any other similar shape, as long as the cross-sectional area of the intake passageway 42 (FIG. 4) remains substantially uniform.

As illustrated in FIG. 2, the adapter 6 is preferably fastened to the cylinder head 4 with bolts 34 that pass through the bolt apertures 36 and into the threaded apertures 38. One skilled in the art will recognize that any suitable fasteners may be used to attach the adapter 6 to the cylinder head 4.

As shown in FIG. 4, the runner filler 26 is at least partially disposed within the intake runner 14 and decreases in cross-sectional area as it extends away from the spacer 24. Together the inclined surface 18 and the passage surface 30 preferably define at least a 30 portion of the intake passageway 42. The intake passageway 42 is preferably a substantially tubular shaped conduit that extends from the inlet 22 to the intake port 10. Preferably, the intake passageway 42 has a substantially uniform cross-sectional area that is substantially the same size as the cross-sectional area of the inlet 22.

Figure 8:
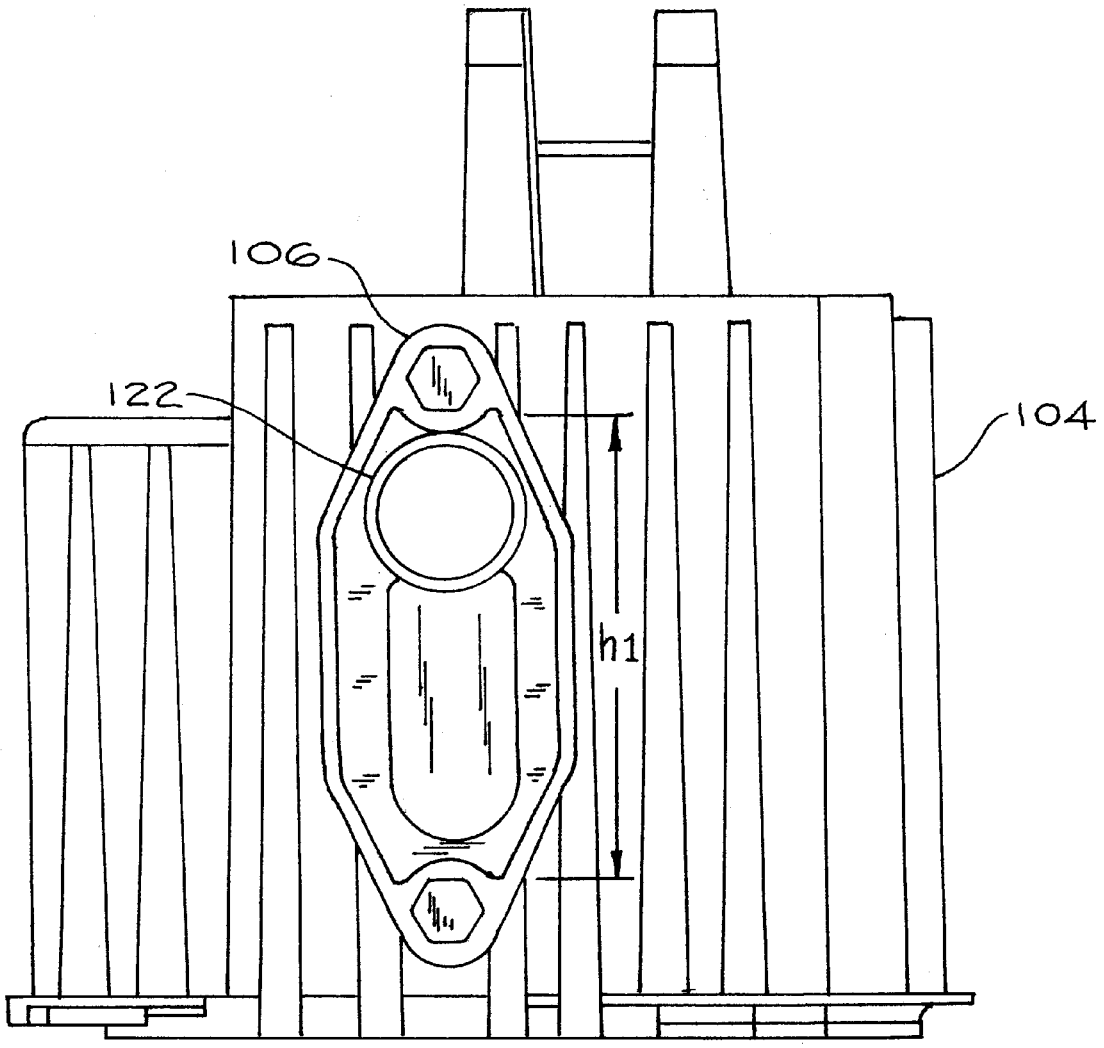
FIG. 8 is a side view of an alternate embodiment of the cylinder head with the position of the intake runner and adapter changed.

FIG. 8 shows an alternate embodiment where the intake runner and adapter 106 are oriented approximately 90 degrees from the position depicted in FIG. 2. In the embodiment in FIG. 8, a line containing the height dimension h1 of the entrance is substantially parallel to a longitudinal axis of a piston cylinder. The actual orientation of the intake runner and adapter 106 to the cylinder head 104 is not critical to the invention. This alternate embodiment allows more options when fitting engines to existing OEM devices, and generates different and improved intake flow characteristics. The angle at which the intake runner can be oriented is only limited by the constraints of the other features of the engine or OEM device which may interfere with the intake runner, such as valves guides, mounting holes, or carburetor or fuel tank location, as well as die construction.

Figure 9:
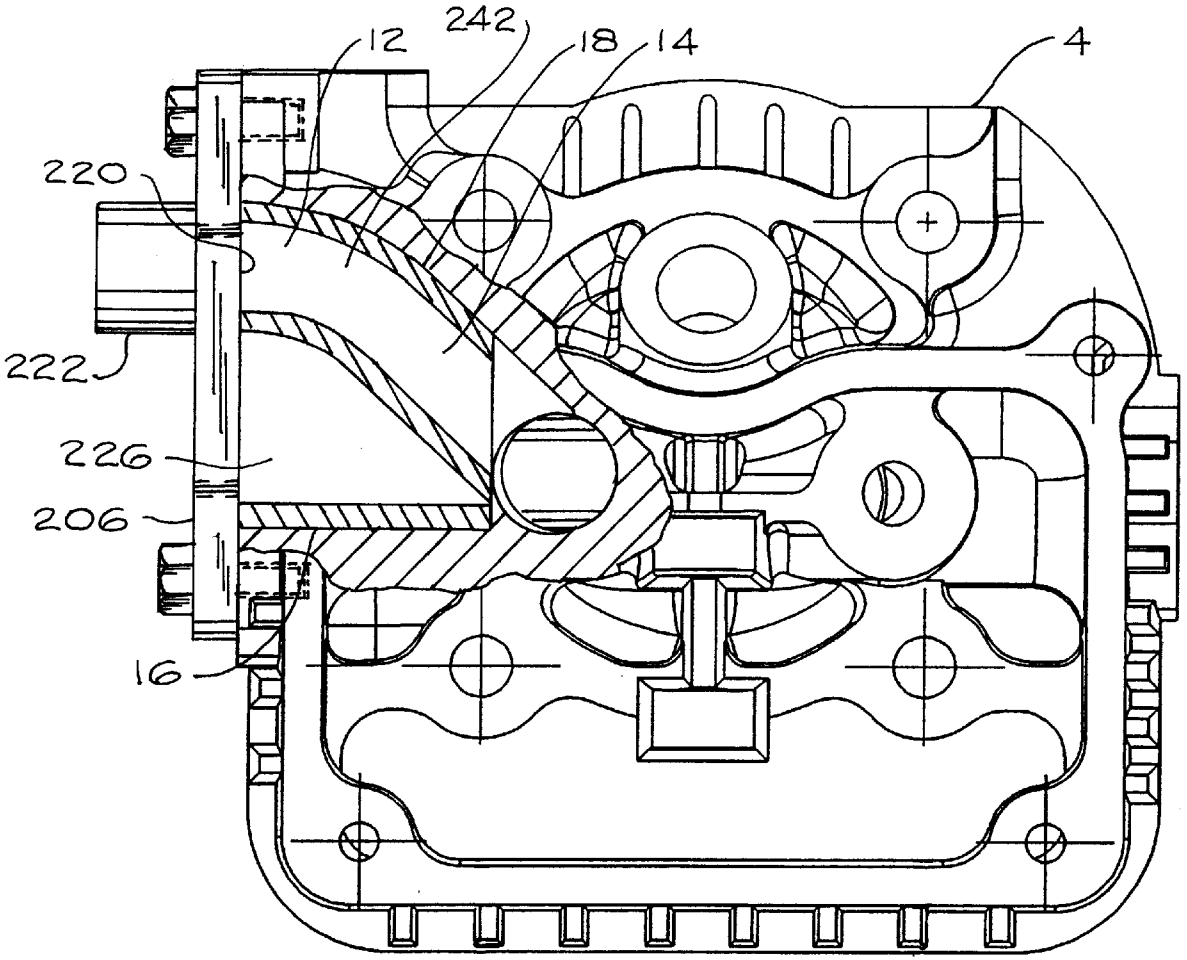
FIG. 9 is a cross-sectional view of the cylinder head assembly with the intake passageway at least partially enclosed within the runner filler.

Another alternate embodiment is shown in FIG. 9 where a section of the intake passageway 242 is completely enclosed within the runner filler 226. In this embodiment the runner filler 226,completely surrounds the spacer opening 220 and entirely defines at least a segment of the intake passageway 242. Only the adapter 206 must be changed to accommodate a slightly different intake position for the engine. Adapters with different intake positions can be used with cylinder heads 4 made with the same intake runner 14. The intake passageway 242 of a conventional cylinder head is usually completely defined by the cylinder head and positioned approximately where the straight side 16 is located in the present invention. In the preferred embodiment of this invention, the inlet 222 is positioned near the inclined side 18 of the intake runner 14. This alternate embodiment allows the inlet 222 to be positioned anywhere along the entrance 12. Changing the location of the inlet 222 and enclosing a portion of the intake passageway 242 within the runner filler 226 omits adapters with an inlet position along this entire range to be used with the same cylinder head 4.

Figure 11:
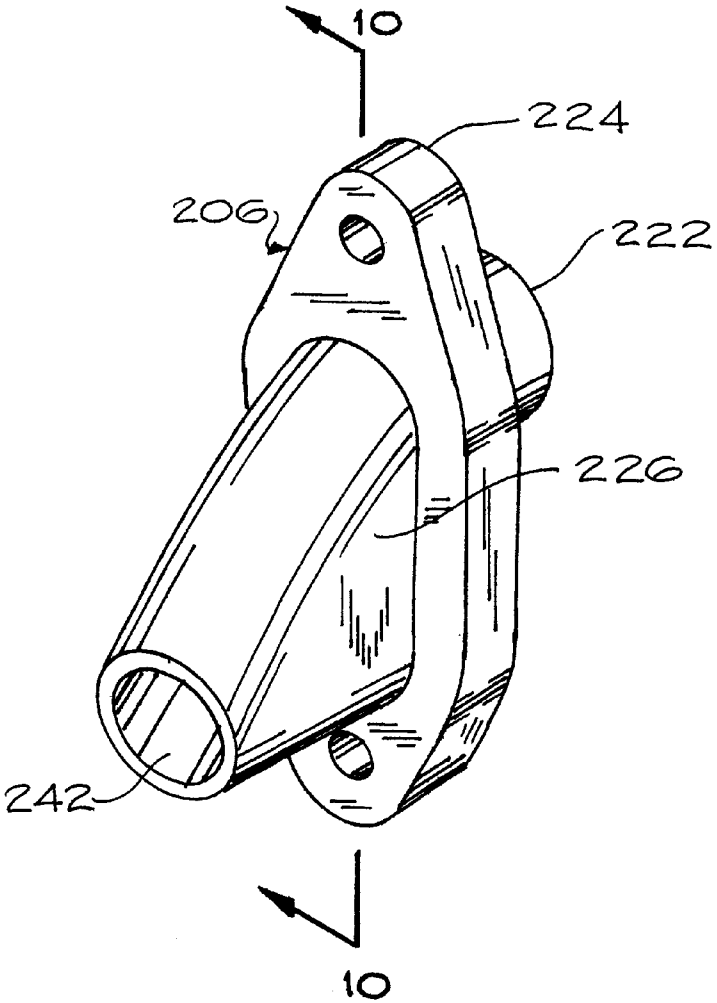
FIG. 11 is a perspective view of the adapter in the alternate embodiment shown in FIG. 9, illustrating the spacer and runner filler.
Figure 10:
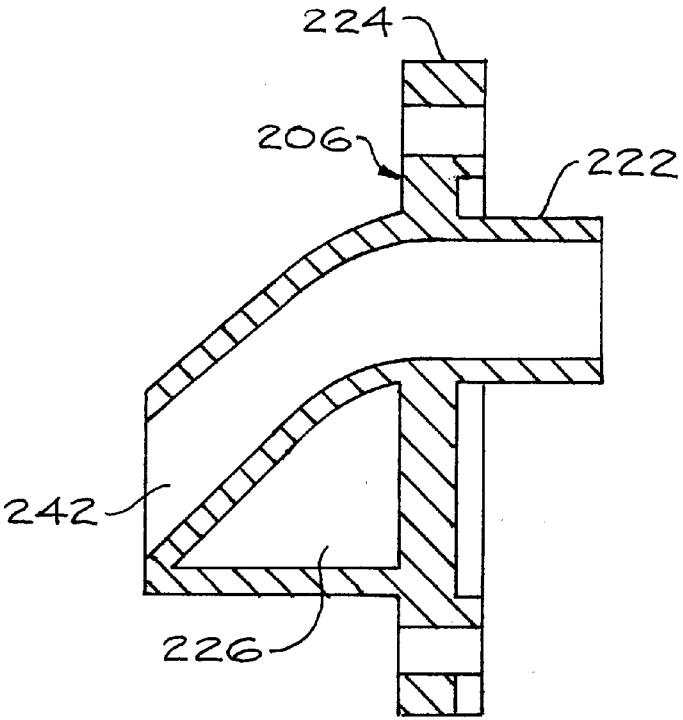
FIG. 10 is a cross-sectional view of the adapter shown in FIG. 9.

FIGS. 10 and 11 illustrate the adapter 206 of this alternate embodiment in more detail. In FIG. 11, a section of the intake passageway 242 is completely enclosed within the runner filler 226. The entire length of the runner filler 226 encloses a portion of the intake passageway 242, however any length of an enclosed segment of the runner filler 226 would be possible. The inlet 22 could also be at any point along theadapter-206 such that the intake passageway 242 still passes through the entrance of the intake runner.

Figure 12:
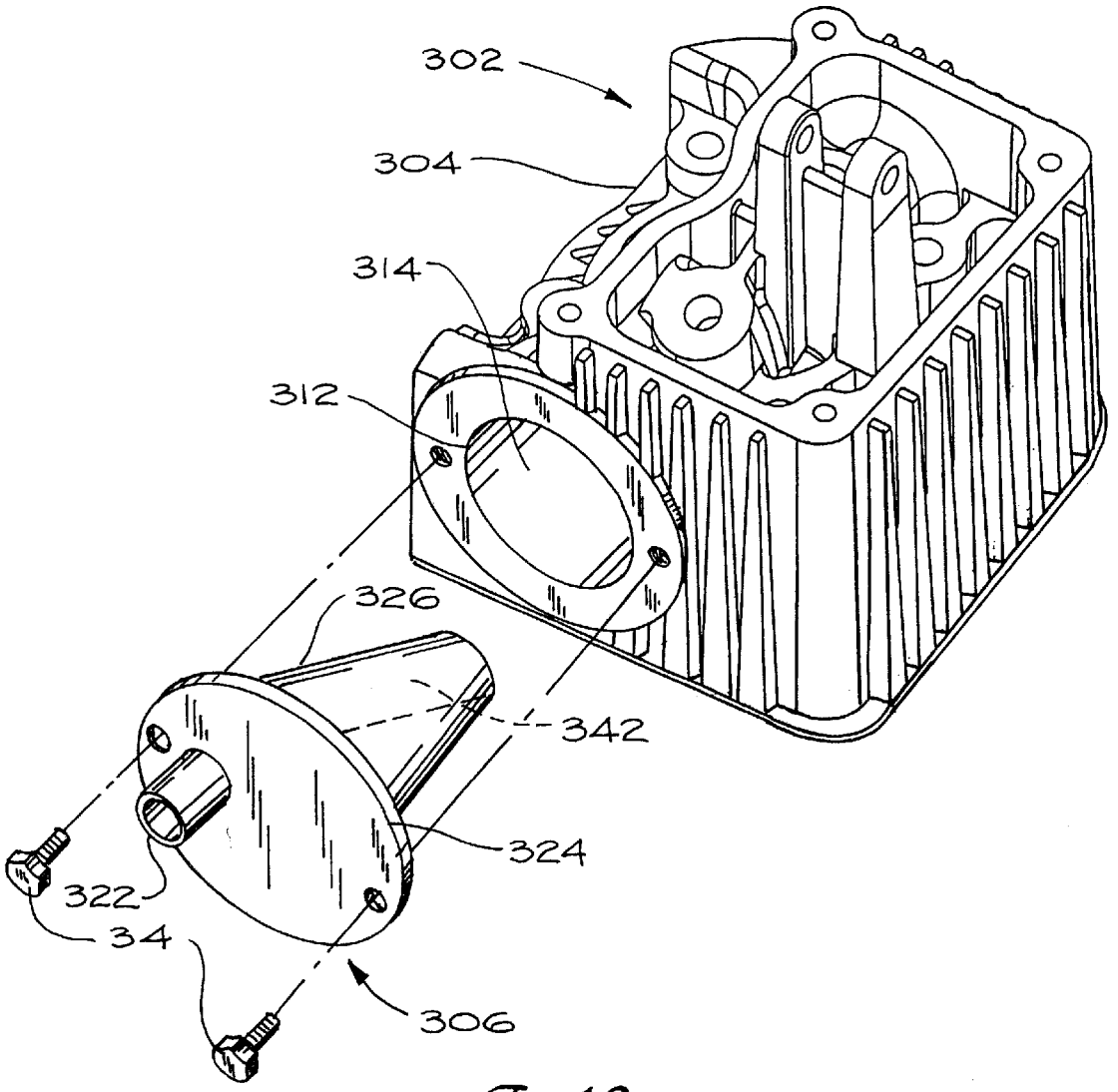
FIG. 12 is a perspective view of an alternate embodiment of the cylinder head assembly; A

FIG. 12 illustrates another alternate embodiment of the cylinder head assembly 302. In this embodiment, the intake runner 314 and the runner filler 326 have a substantially circular cross-section. The cross-sectional area of the intake runner 314 preferably decreases as the intake runner 314 progresses inward from the entrance 312. The intake runner 314 and runner filler 326 may have a substantially conical shape. The intake passageway 342 may be enclosed by the runner filler 326. This embodiment allows the inlet 322 to be located at almost any point on the face of the spacer 324, as long as fluid losses are minimized and as long as the inlet 322 passes though the spacer 324 to intersect with the intake passageway 342 within the runner filler 326. Therefore, a greater range of intake potions are possible by only changing he adapter-306 and using the same cylinder head 304. Other variations are also possible with the cross-section of the intake runner 314 and runner 326 being any shape between an ellipse and circle.

Figure 13:
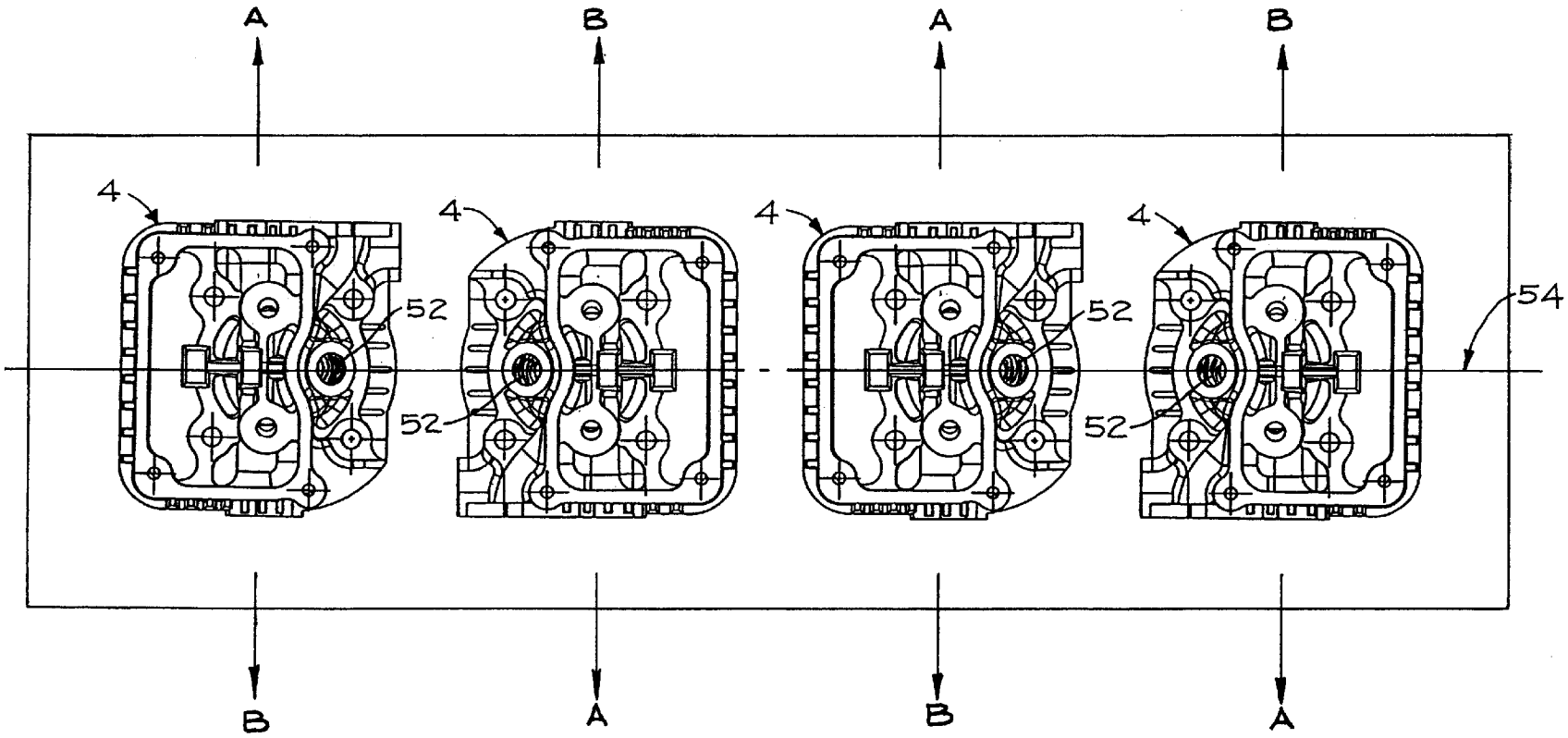
FIG. 13 is a schematic representation of four cylinder heads which are capable of being produced using one compact die tool and one die casting machine.

FIG. 13 depicts a layout for the die used to manufacture cylinder heads 4 according to the present invention. The cylinder head 4 is preferably designed to permit four cylinder heads 4 to be produced using one compact die tool and one die casting machine. The cylinder head is designed to include walls which allow for the needed draft angles given different orientations for each cylinder head within the die tool. The draft angles enable the cylinder head 4 to readily separate from the die. The cylinder head 4 is preferably designed to permit slide tooling access (i.e., the intake runner and exhaust passageway) when four cylinder heads are fabricated from one tool.

In FIG. 13, the die is formed so that the spark plug holes 52 of corresponding cylinder heads 4 are adjacent to each other. The die is arranged so that the inserts which form the cavity of the intake runner 14 move in direction A, and the inserts which form the exhaust passageway 36 move in direction B. In a preferred embodiment, the die is positioned so that the directions A and B alternate in adjacent cylinder heads.

By positioning the cylinder heads 4 in the manner described, the inserts used to form the cylinder heads are moved only along two directions, i.e., in directions A and B. This die configuration reduces the overall space required to make the cylinder heads 4, while still enabling four cylinder heads 4 to be made at the same time.

The embodiments described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed:

1. A cylinder head assembly for an internal combustion engine comprising:

an intake port;

an intake runner that receives at least one of air and fuel, said intake runner including:

an entrance;

a section having a first end nearer said entrance and having a second end nearer said intake port;

an adapter having a runner filler disposed within said intake runner;

an intake passageway having a substantially uniform cross-sectional area created at least in part by said runner filler; and wherein the cross-sectional area of said intake runner decreases from said entrance to said intake port.

2. A cylinder head assembly according to claim 1, wherein said intake runner includes:

an inclined surface with a semi-circular cross section; and a straight surface with the shape of an interior surface of a segmented cylinder.

3. A cylinder head assembly according to claim 1, wherein said runner filler has a contact surface with the shape of an exterior surface of a segmented cylinder.

4. A cylinder head assembly according to claim 1, wherein said intake passageway is formed by said section and said runner filler.

5. A cylinder head assembly according to claim 1, wherein said entrance is elliptical in shape.

6. A cylinder head assembly according to claim 1, wherein said entrance has a eight dimension and a width dimension, said height dimension being greater than said width dimension.

7. A cylinder head assembly according to claim 6, wherein a line including said height dimension is substantially transverse to a longitudinal axis of a piston cylinder.

8. A cylinder head assembly according to claim 6, wherein a line including said height dimension is substantially parallel to a longitudinal axis of a piston cylinder.

9. A cylinder head assembly according to claim 1, wherein said entrance is substantially circular in shape.

10. A cylinder head assembly according to claim 1, wherein said entrance has a height dimension and a width dimension, said height dimension being substantially the same as said width dimension.

11. A cylinder head assembly according to claim 1, wherein said cylinder head assembly includes a cylinder head, and said adapter thermally insulates a carburetor from said cylinder head.

12. A cylinder head assembly according to claim 11, wherein said adapter has a spacer that thermally insulates a carburetor from said cylinder head.

13. A cylinder head assembly according to claim 1, wherein said adapter has a substantially cylindrical inlet.

14. A cylinder head assembly according to claim 1, wherein said intake passageway has a portion that is completely formed by said runner filler.

15. A cylinder head assembly for an internal combustion engine comprising:

an intake port;

an intake runner that receives at least one of air and fuel, said intake runner including:

an entrance;

a section having a first end nearer said entrance and having a second end nearer said intake port;

an adapter having a runner filler positioned in said intake runner; and an intake passageway disposed within said intake runner and at least partially defined by said runner filler, wherein the position of said intake passageway is selectable based upon at least one of the position and the configuration of said runner filler.

16. The cylinder head assembly of claim 15, wherein said intake passageway has a substantially uniform cross-sectional area.

17. The cylinder head assembly of claim 15, wherein the cross-sectional area of said intake runner decreases from said entrance to said intake port.

18. The cylinder head assembly of claim 15, wherein said entrance is substantially elliptical in shape.

19. The cylinder head assembly of claim 15, wherein said cylinder head assembly includes a cylinder head, and wherein said adapter thermally insulates a carburetor from said cylinder head.

20. The cylinder head assembly of claim 19, wherein said adapter includes a spacer that thermally insulates said carburetor from said cylinder head.

21. The cylinder head assembly of claim 15, wherein said adapter includes a substantially cylindrical adapter inlet.

22. A cylinder head assembly for an internal combustion engine comprising:

an intake port;

an intake runner that receives at least one of air and fuel, said intake runner including an entrance having a height dimension that is greater than a width dimension of said entrance;

an adapter having an inlet, and having a runner filler positioned in said intake runner; and an intake passageway at least partially defined by said runner filler, said intake passageway extending from an inlet near said entrance, wherein the position of said inlet is selectable along said height dimension.

23. The cylinder head assembly of claim 22, wherein the cross-sectional area of said intake runner decreases from said entrance to said intake port.

24. The cylinder head assembly of claim 22, wherein said intake passageway has a substantially uniform cross-sectional area.

25. The cylinder head assembly of claim 22, wherein the cross-sectional area of said intake passageway is less than the cross sectional area of said intake runner.

26. The cylinder head assembly of claim 22, wherein the cross-sectional area of said inlet is less than the cross-sectional area of said entrance.

27. The cylinder head assembly of claim 22, wherein said entrance is substantially elliptical in shape.

28. The cylinder head assembly of claim 22, wherein said cylinder head assembly includes a cylinder head, and said adapter thermally insulates a carburetor from said cylinder head.

29. The cylinder head assembly of claim 27, wherein said adapter includes a spacer that thermally insulates said carburetor from said cylinder head.

30. The cylinder head assembly of claim 26, wherein said adapter includes a substantially cylindrical adapter inlet.

31. The cylinder head assembly of claim 22, wherein the position of said intake passageway is selectable based upon at least one of the position and the configuration of said runner filler.

* * * * *